US010883323B2

(12) United States Patent
Haggart et al.

(10) Patent No.: US 10,883,323 B2
(45) Date of Patent: Jan. 5, 2021

(54) ROTATING CONTROL DEVICE HEAD INSTALLER AND REMOVER

(71) Applicant: Pro Torque Connection Technologies Ltd., Edmonton (CA)

(72) Inventors: Steven Haggart, Spruceview (CA); Landon McDonald, Armstrong (CA)

(73) Assignee: ProTorque Connection Technologies, Edmonton (CA)

( * ) Notice: Subject to any disclaimer, the term of this patent is extended or adjusted under 35 U.S.C. 154(b) by 0 days.

(21) Appl. No.: 16/028,245

(22) Filed: Jul. 5, 2018

(65) Prior Publication Data

US 2019/0338607 A1 Nov. 7, 2019

(30) Foreign Application Priority Data

May 4, 2018 (CA) ..... 3004024

(51) Int. Cl.
*E21B 19/08* (2006.01)
*E21B 19/16* (2006.01)
*E21B 19/086* (2006.01)

(52) U.S. Cl.
CPC ..... *E21B 19/165* (2013.01); *E21B 19/086* (2013.01); *E21B 19/163* (2013.01)

(58) Field of Classification Search
USPC ..... 166/380
See application file for complete search history.

(56) References Cited

U.S. PATENT DOCUMENTS

| | | | | |
|---|---|---|---|---|
| 8,936,096 | B2 | 1/2015 | Marshall | |
| 9,212,778 | B2 | 12/2015 | Winter | |
| 2012/0006565 | A1 | 1/2012 | McKinnon et al. | |
| 2013/0168516 | A1* | 7/2013 | Winter | F16M 13/022 248/274.1 |
| 2013/0284454 | A1* | 10/2013 | Marshall | E21B 33/085 166/377 |
| 2014/0291027 | A1* | 10/2014 | Marshall | E21B 19/00 175/57 |
| 2016/0123399 | A1* | 5/2016 | Arnt | E21B 33/085 384/559 |
| 2016/0245028 | A1* | 8/2016 | Arnt | E21B 23/00 |
| 2019/0017326 | A1* | 1/2019 | Orban | E21B 3/02 |

FOREIGN PATENT DOCUMENTS

CA 2486896 5/2006

* cited by examiner

*Primary Examiner* — Taras P Bemko

(57) ABSTRACT

A device and method for installing a pipe into a rotating control device (RCD) head and for removing a pipe out from a RCD head are described. The device includes a body section for receiving and securing a RCD head placed thereon; and a scoping section configured to secure a first end of the pipe, and to push the first end of the pipe into a bore of the RCD head or to pull the first end of the pipe out from bore of the RCD head. The body section is configured to be substantially stationary when the scoping section pushes the first end of the pipe into the bore of the RCD head, or when the scoping section pulls the first end of the pipe out from the bore of the RCD head.

26 Claims, 11 Drawing Sheets

ROTATING CONTROL DEVICE HEAD INSTALLER AND REMOVER

CROSS-REFERENCE TO RELATED APPLICATION

This application claims the benefit of Canadian Patent Application No. 3004024 filed May 4, 2018, which is hereby incorporated by reference in its entirety herein.

BACKGROUND OF THE INVENTION

I. Field of the Invention

The present disclosure relates to tools for rig drilling equipment, in particular, to a device and method for installing a pipe into a rotating control device (RCD) head and for removing a pipe out from a RCD head.

II. Description of the Prior Art

The RCD is typically mounted on top of the annular blowout preventer (BOP) beneath the rig floor. A RCD head and a drilling pipe, which is also known as a joint or a casing joint (hereafter "pipe"), are heavy and difficult to maneuver on rig floor. A pipe may be a steel pipe, generally around 9 m or 13 m long, with a threaded connection at each end. Drilling pipes are assembled to form a drill string of the correct length and specification for the wellbore.

Traditionally, the pipes are vertically installed on and vertically removed from the RCD head on the rig floor. The installation and removal processes are time consuming and dangerous to the rig crew. The rig floor is a relatively small work area in which the rig crew conducts operations, such as installing the RCD head on the pipe and removing the pipe from the RCD head, and adding or removing drill pipe to or from the drill string. The rig floor is the most dangerous location on the rig because heavy items, such as the pipes and RCD head, are moved around there. Occasionally, due to the very limited work area on the rig floor and the difficulty to maneuver the pipe and RCD head, there are multiple steps when the rig crew may be injured during the process of vertically installing a RCD head on a pipe or vertically removing a RCD head on a pipe, for example, when a RCD or pipe "slips" during the installation or removal process.

The present application provides a RCD head installer and remover, a method to install a pipe on a RCD head, and a method to remove a pipe from a RCD head. The RCD head installer and remover allows the pipe to be horizontally installed on the RCD head or horizontally removed from the RCD head at a work area away from the rig floor. Therefore, the RCD head installer and remover take a work safety hazard on the rig floor away from the rig crew. As well, with the RCD head installer and remover, unlike on the rig floor, heavy RCD head and heavy pipe do not have to be vertically lifted up in order to install the pipe on the RCD on or remove the pipe from the RCD. As such, the installation process and the removal process with the RCD head installer and remover are safer and faster than those on the rig floor, and effectively save inline time and costs in these processes.

These and other objects, features and advantages of this disclosure will be clearly understood through a consideration of the following detailed description.

SUMMARY OF THE INVENTION

According to an embodiment of the present disclosure, there is provided a device for installing a pipe to a rotating control device (RCD) head or for removing the pipe from the RCD head. The device includes a body section for receiving and securing a RCD head horizontally placed thereon; and a scoping section configured to secure a first end of the pipe, and to horizontally push the first end of the pipe into a bore of the RCD head or to horizontally pull the first end of the pipe out from the bore of the RCD head, wherein the body section is configured to be substantially stationary when the scoping section horizontally pushes the first end of the pipe into the bore of the RCD head, or when the scoping section horizontally pulls the first end of the pipe out from the bore of the RCD head.

According to another embodiment of the present disclosure, these is provided a method of installing a pipe into a RCD head. The method includes securing a RCD head placed horizontally in a body section of a RCD head installer; securing a first end of a pipe on a pipe retention member on a scoping section of the RCD head installer; and inserting the first end of the pipe into a front end bore of the RCD head by pushing horizontally the scoping section towards the body section.

According to another embodiment of the present disclosure, there is provided a method of removing a pipe out from a RCD head. The method includes securing a RCD head placed horizontally in the body section of an RCD head installer; securing a first end of a pipe on a pipe retention member on the scoping section; and removing the first end of the pipe out from a front end bore of the RCD head by pulling horizontally the scoping section away from the body section.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

Figure 1:
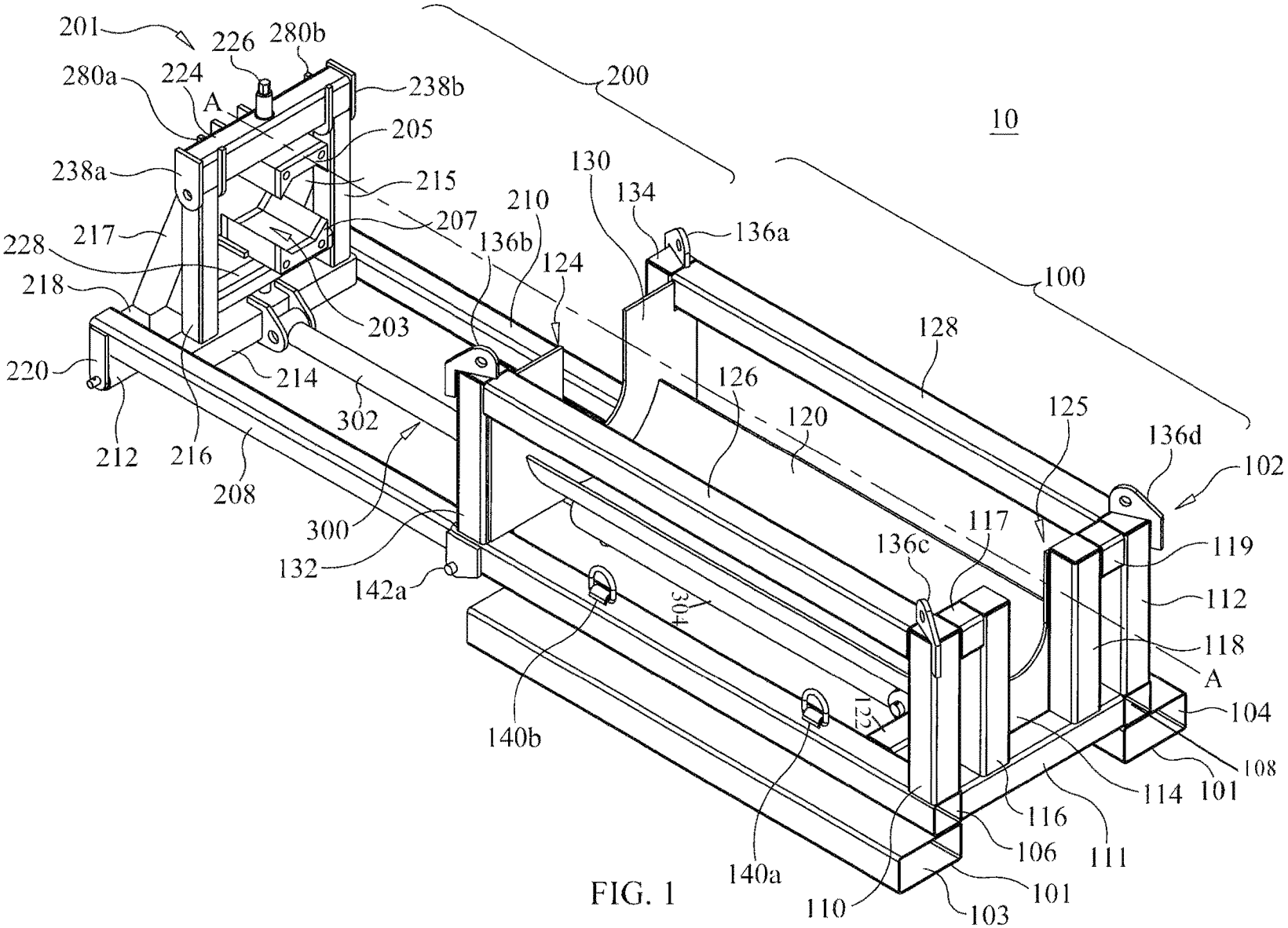
FIG. 1 is a rear perspective view of an RCD head installer and remover, according to an embodiment.

One or more embodiments of the subject disclosure will now be described with the aid of numerous drawings. Unless otherwise indicated, use of specific terms will be understood to include multiple versions and forms thereof.

Reference is made to FIGS. 1-9. FIGS. 1-5 illustrate an exemplary embodiment of an RCD head installer and remover 10, and FIGS. 6-9 illustrate another exemplary embodiment of an RCD head installer and remover 20. Both RCD head installer and remover 10 or 20 include a body section 100, and a scoping section 200.

The body section 100 is configured to receive and securely retain a horizontally placed RCD head. A horizontally placed RCD head has a front end and a rear end. The front end of the RCD has a bore, or a rubber element, for receiving a pipe. The scoping section 200 is moveable in relation to the body section 100. The scoping section 200 is configured to securely retain an end of a pipe and to insert a section of the pipe into or to remove the section of the pipe out from the RCD head. The body section 100 is substantially stationary when the scoping section 200 is inserting the pipe into or removing the pipe out from the RCD head. The body section 100 and the scoping section 200 may be made of materials that are capable of achieving their respective functions. The materials may be, for example, wood, metal such as steel, or combination of both. An actuator 300, which will be described in great detail below, may be used to provide pushing force for the scoping section 200 to insert a section of the pipe into the pipe, and pulling force for the scoping section 200 to pull the pipe out from the RCD head.

The body section 100 includes a base 101 and a main frame 102. The base 101 has a frictional surface for contacting with a surface on which the body section 100 is placed. The surface may be a ground surface, for example with pavement. The frictional surface of base 101 may be selected to have a high coefficient of static friction, such as equal or greater than 0.5, to generate a adequate friction force between the frictional surface and the surface to keep the body section 100 substantially stationary when the scoping section 200 inserts the pipe in or pull the pipe out from the RCD head. For example, the frictional surface have a coarse surface.

The main frame 102 is supported by and securely attached to the base 101. Unless described otherwise, an element of the RCD head installer and remover 10 or 20 may be connected with or secured to another element known to a person skilled in the art, for example by welding, or by fasteners such as bolts and nuts or threaded bolts or threaded bores. The main frame 102 receives and securely retains a horizontally placed RCD head. The base 101 and the main frame 102 together keep the received RCD stationary when the pipe is horizontally pushing into the RCD head or when the pipe is horizontally pulled out from the RCD head. The term "horizontal" refers to the direction that is substantially along the longitudinal axis AA of the body section 100 (See FIGS. 1 and 6).

In the example of FIG. 1, the base 101 includes two elongated parallel base beams 103 and 104. With a given coefficient of friction, the wider or the longer the base beams 103 and 104 are, the larger frictional surfaces the base 101 has, and as such, the greater friction is generated between the base section 100 and the surface on which the body section 100 is placed. As illustrated in FIG. 1, the base beam 103 has a rear end and a font end, and the base beam 104 has a rear end and a font end. The rear ends and the front ends may have rectangular cross sections. The base 101 may also take other forms, such as a trapezoid, as long as friction between the frictional surface and the surface sufficiently keep the body section 100 stationary in response to the push and pull forces from the scoping section 200. In another example, the base 101 may be a single piece of metal plate.

The main frame 102 includes a horizontal support base 120 for receiving a horizontally placed RCD head. A front barrier 124 prevents the front end of the RCD head from moving toward the scoping section 200 when the scoping section 200 pulls a pipe connected with the RCD head out from the RCD head, and a rear barrier 125 prevents the rear end of the RCD head from moving away from the scoping section 200 when the scoping section 200 pushes a pipe into the RCD head. The front barrier 124 may be omitted if the body section 100 is only used to insert the pipe into the RCD head, namely that the RCD head installer and remover 10 or 20 is only used as an RCD installer. In this case, the main frame 102 may only include the support base 120 and the rear barrier 125. Similarly, the rear barrier 125 may be omitted if the body section 100 is only used to pull the pipe out from the RCD head, namely that the RCD head installer and remover 10 or 20 is only used as an RCD remover. In this case, the main frame 102 may only include the support base 120 and the front barrier 124.

The support base 120 may be placed between the front barrier 124 and the rear barrier 125. The support base 120 has two ends, with one end securely connected with the front barrier 124 and the other end securely connected with the rear barrier 125. In an example, the distance between the front board 130 and the rear board 114 is about 54". The support base 120 provides a surface for receiving the RCD head. The support base 120 may have a surface that substantially corresponds to a partial contour of the RCD head. For example, the RCD support base 120 has a curved surface. When the RCD is received in the support base 120, in an example, the front end of the RCD head is substantially against the front barrier 124, and the rear end of the RCD head is substantially against the rear barrier 125.

In another example, the support base 120 may be placed on and connected with the base 101, for example, when the base 101 is a single metal plate.

In an embodiment, the front barrier 124 and the rear barrier 125 may be directly placed on and supported by the base 101.

As illustrated in FIG. 1, the main frame 102 includes two substantially parallel bottom beams 106 and 108. The bottom beams 106 and 108 are placed on the base 101, such as on the top surfaces close to inner edges of respective base beams 103 and 104. The bottom beams 106 and 108 are placed. The base beams 103 and 104 are wider than the bottom beams 106 and 108. The front barrier 124 and the rear barrier 125 are placed on and supported by bottom beams 106 and 108. In the example of FIG. 1, each of the bottom beams 106 and 108 is a rectangular elongated beam with a rear end, and a front ends, respectively. In an example, rear ends of 106 and 108 are substantially aligned with the rear ends of 103 and 104. The bottom beams 106 and 108 may be secured to the respective base beams 103 and 104.

In an example, each of the bottom beams 106 and 108 is a hollow beam and is configured to receive a core beam of the scoping section 200 into the hollow beams. The scoping section 200 will be described in great detail below. The bottom beams 106 and 108 may be an inverted channel, such as a Π shaped hollow beams. At least one roller may be mounted to each of the bottom beams 106 and 108 to facilitate receiving a core beam of the scoping section 200. For example, a roller 142*a* (FIG. 8) is rotatably mounted, for example by bolts and nuts, to the bottom beam 106 at the bottom of the front end 106*b* and a roller 142*b* (FIG. 8) is rotatably mounted on the bottom bream 108 at the bottom of the front end 108*b*. The rollers 142*a* and 142*b* reduce binding between the core beam and the respective hollow beam and facilitate receiving the core beams into the respective hollow beams.

In an example, the body section 100, such as each of the bottom beams 106 and 108 or the base beams 103 and 104, has a plurality of securement or adapter plates for securing different styles of RCD head, for centralizing as well as delivering the torque to the correct portion of the RCD head, and for not damaging the RCD head such as the rubber element of the RCD head. In the example of FIG. 1, bottom beam 106 has two D-ring tie downs 140*a* and 140*b* and bottom beam 108 has two corresponding D-ring tie downs (not shown), for example substantially symmetrical with tie downs 140*a* and 140*b* with respect to axis A-A, for securing the RCD on the main frame 102 with tie down straps.

In an example, the rear barrier 125 includes two elongated rear beams 110 and 112, and a rear board 114 attached to the front surfaces of the rear beams 110 and 112. The rear beams 110 and 112 are vertically connected to the respective top surfaces of the bottom beams 106 and 108. The rear beams 110 and 112 may be rectangular and parallel to each other. In FIG. 1, each of the rear beams 110 and 112 has a top end and a bottom end. The bottom ends of the rear beams 110 and 112 are connected to the top surfaces of the bottom beams 106 and 108 and close to the rear ends of 106 and 108, for example, by welding or bolting the bottom ends of the rear beams 110 and 112 with the top surfaces of the bottom beams 106 and 108, respectively.

The rear beams 110 and 112 reinforce the rear board 114 against the push force transmitted from the RCD head when a pipe is pushed into the RCD head. The rear beams 110 and 112 and rear board 114 collectively prevent the RCD head from moving backward when a pipe is pushed into the RCD head. In an example, the rear board 114 has a U-shaped carve-out substantially in the middle rear board 114. The U-shaped carve-out is configured to allow the pipe to pass through the RCD head and to protrude the rear board 114, so that the pipe can be made-up on the rig floor.

The rear barrier 125 may include a horizontal beam 111 securely placed between two bottom beams 106 and 108, or between the base beams 103 and 104, for example by welding or bolting. Two vertical beams 116 and 118 may be connected to the top surface of the horizontal beam 111, for example by welding or bolting, and placed between the two rear beams 110 and 112. In this case, the vertical beams 116 and 118 serve as additional reinforce to the rear board 114 against the push force from the RCD head when a pipe is pushed into the RCD head. The rear board 114 is attached to the inner surfaces of the beams 116 and 118. Optionally, the rear board 114 may attach to the top surface of the horizontal beam 111. In this case, horizontal beam 111 also serves as an additional reinforcement to the rear board 114 against the push force from the RCD head.

The support base 120 may be connected with the rear barrier 125 by connecting with two rear beams 110 and 112, the rear board 114, or both.

The front barrier 124 may include two elongated front beams 134 and 136, and a front board 130 attached to the front beams 134 and 136, such as to the rear surfaces of the front beams 134 and 136 as shown in the example of FIG. 1. The front beams 134 and 136 are vertically connected to the respective top surfaces of the bottom beam 106 and 108. The front beams 134 and 136 may be rectangular and parallel to each other. In FIG. 1, each of two front beams 134 and 136 has a top end and a bottom end. The bottom ends of the front beams 134 and 136 are connected to the top surfaces of the bottom beams 106 and 108 close to the front ends 106*b* and 108*b* (see FIG. 6), respectively.

The front board 130 is substantially parallel to the rear board 114. The front beams 134 and 136 reinforce the front board 130 against the pull force transmitted from the RCD head when a pipe is pulled out from the RCD head. The front beams 134 and 136 and front board 130 collectively prevent the RCD head from moving toward the scoping section 200 when a pipe is pulled out from the RCD head.

The front board 130 is configured to allow a pipe through the board 130. In an example, the front board 130 has a U-shaped carve-out substantially in the middle the front board 130. The U-shaped carve-out allows the pipe to go through the front board 130 in order to be pulled out from the front end of the RCD head or to be pushed into the front end of the RCD head. One or more beams may be included in the front barrier 124 to reinforce the front board 130. For example, a horizontal beam may be added between and close to the bottom portions of the two front beam 134 and 136, and one or more vertical beams may be added between the two front beam 134 and 136.

The support base 120 may be connected with the front barrier 124 by connecting with two front beams 134 and 136, the front board 114, or both. In an example, the support base 120 is placed between the rear board 114 and the front board 130.

In an example, the distance between the rear board 114 and the front board 130 is fixed based on specific dimensions of a specific RCD head, such as the maximum known RCD head size. A variety of adapters may be used for the RCD head installer and remover 10 or 20 to receive RCD heads with different sizes, for example by centering a RCD head on the support base 120. In another example, the distance between the rear board 114 and the front board 130 is adjustable to snugly receive the RCD heads with difference sizes placed on the support base 120.

The main frame 102 may include a plurality of lifting lugs for lifting the RCD installer and remover 10 or 20. In an example, each top end of front beams 134 and 136 and rear beams 110 and 112 may be securely connected with a lifting lug, such as 136*b* on the front beam 134, 136*a* on the front beam 134, 136*c* on the rear beam 110, and 136*d* on the rear beam 112. The lifting lugs 136*a*-136*d* may be used to lift the RCD head installer and remover 10, for example from a truck, to the ground with a sling.

Main frame 102 may further include two top beams 126 and 128 placed above the base beams 103 and 104, and the bottom beams 106 and 108 if included, for preventing the left or right side movement of the RCD head, and for reinforcing the structure of the main frame 102. As illustrated in FIG. 1, top beam 126 has one end connected to an top portion of the front beam 136, and the other end connected to an top portion of the rear beam 110; and top beam 128 has one end connected to an top portion of the front beam 134, and the other end connected to an top portion of the rear beam 112. In an example, the two top beams 126 and 128 are placed substantially at the same height from the base 101.

The scoping section 200 is configured to secure a pipe and to be movable in relation to the body section 100. The scoping section 200 includes a support frame 201, and a retention member 203 for securely retaining an end of a pipe. The support frame 201 securely retains the retention member 203 (see FIG. 5). The support frame 201 is configured to be horizontally moveable in relation to the body section 100. An actuator, which will be described in greater detail below, may be used for driving the scoping section 200 toward or away from the body section 100.

The retention member 203, which will be described in greater detail below, may be for example a pair of adjustable die carriers or jaws 205 and 207. The support frame 201 and the adjustable top jaw 205 and bottom jaw 207 collectively are configured to be moveable towards the body section 100 when a push force is applied on the scoping section 200 by the actuator 300, and away from the body section 100 when a pull force is applied on the scoping section 200 by the actuator 300.

In the example illustrated in FIGS. 1-5, the support frame 201 includes two parallel longitudinal beams 208 and 210, a roller 212, a bottom horizontal beam 214, two vertical beams 215 and 216, a top horizontal beam 224, and a middle horizontal beam 228.

Figure 2:
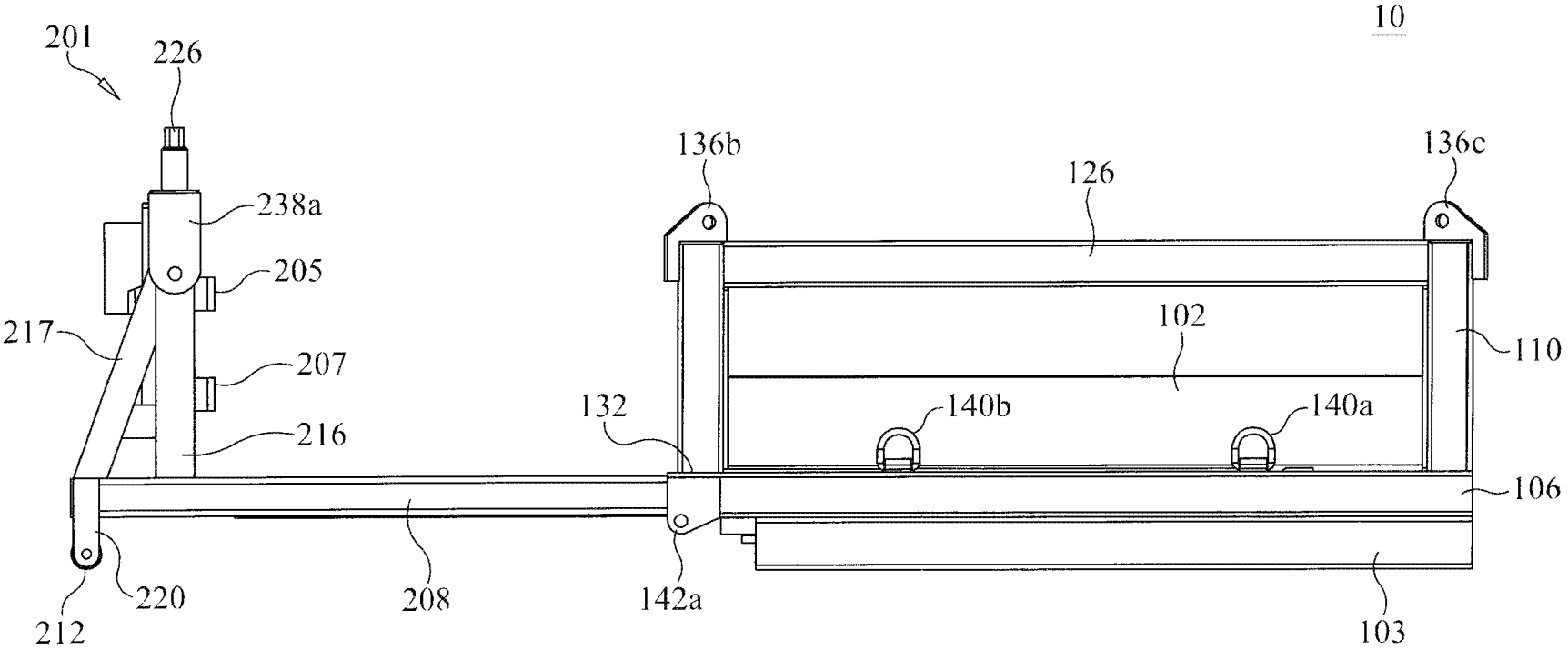
FIG. 2 is a side view of the RCD head installer and remover of FIG. 1, with the scoping section in an extended from the body section.
Figure 3:
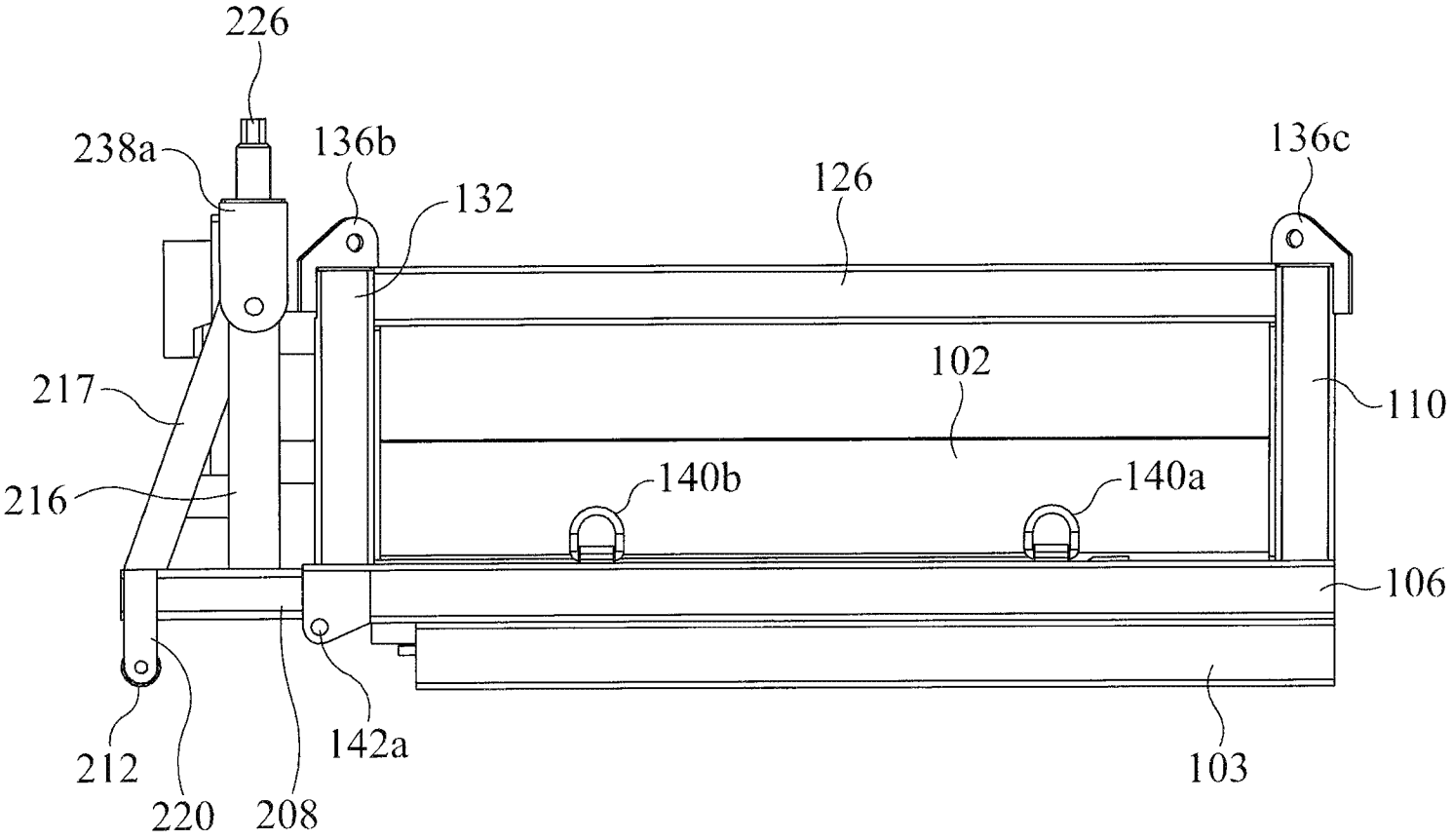
FIG. 3 is a side view of the RCD head installer and remover of FIG. 1, with scoping section retracted to body section.
Figure 4:
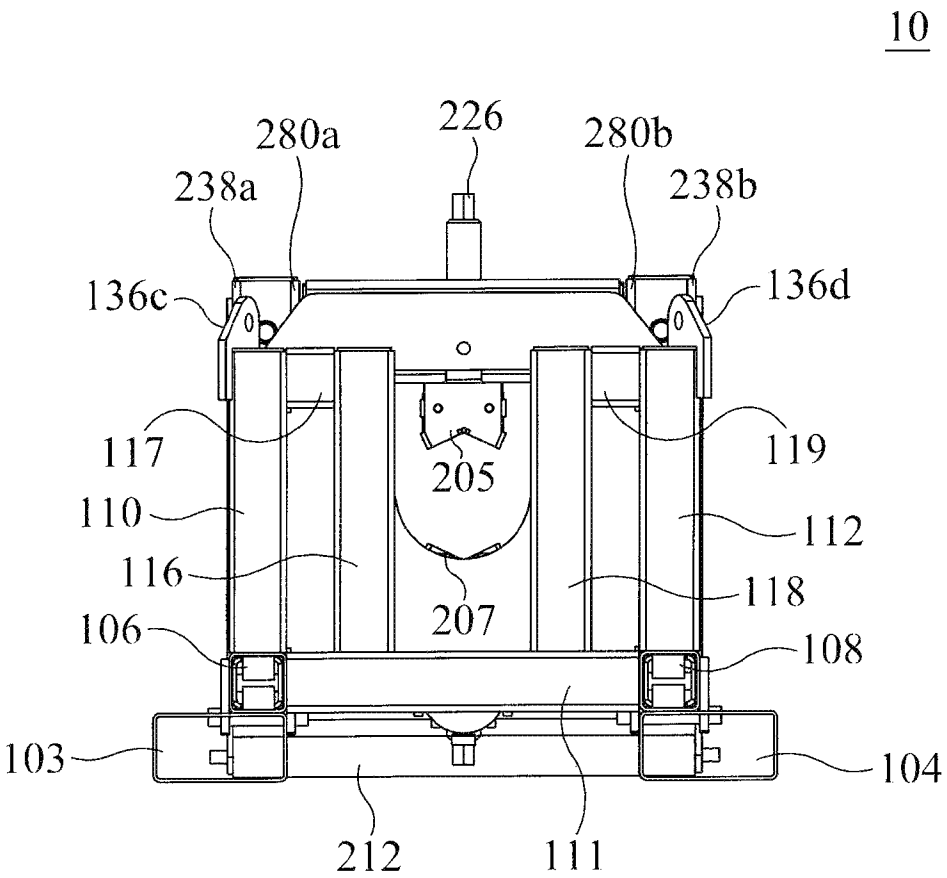
FIG. 4 is a rear view of the RCD head installer and remover of FIG. 1.
Figure 5:
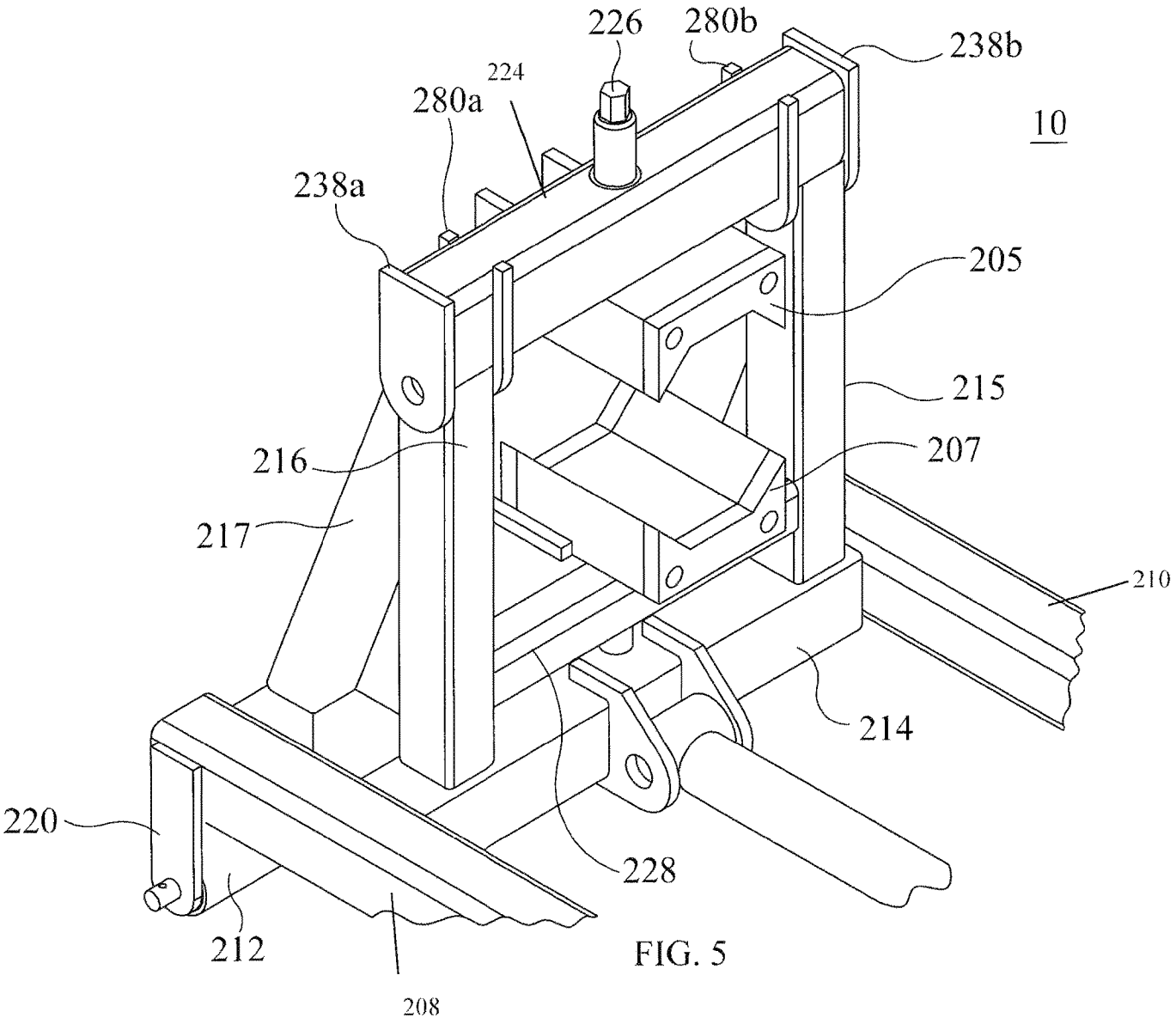
FIG. 5 is an enlarged view of the support frame of the RCD head installer and remover of FIG. 1.

The beams 208 and 210 each have a front end and a rear end. In the example, the rear ends of beams 208 and 210 are received, via the rollers 142*a* and 142*b* (FIG. 8), in the hollow bottom beams 106 and 108, respectively. The rollers 142*a* and 142*b* support the respective beams 208 and 210, and facilitate sliding beams 208 and 210 into the respective hollow bottom beams 106 and 108. With a push force applied on the scoping section 200, such as on the support frame 201, the scoping section 200 moves towards the body section 100, the beams 208 and 210 slide into the respective the hollow bottom beams 106 and 108, and the RCD head installer and remover 10 or 20 is in a retracted position as shown in FIG. 3. With a pull force applied on the scoping section 200, such as on the support frame 201, the scoping section 200 moves away from the body section 100, the beams 208 and 210 slide out from the respective hollow bottom beams 106 and 108, and the RCD head installer and remover 10 or 20 is in an extended position as shown in FIG. 2. This sliding arrangement improves the stability of the scoping section 200 by restricting the left and right movements of the scoping section 200 and thus helps align an end of a pipe with the front end bore of RCD head.

However, the sliding arrangement is optional. For example, the bottom beams 106 and 108 may be solid beams, rollers 142*a* and 142*b* can be omitted, and the beams 208 and 210 may be shorter, for example from the roller 212 at the front ends of the beams 208 and 210 to the bottom horizontal beam 214.

The roller 212 is rotatably mounted on beams 208 and 210 close to their front ends. The roller 212 supports the scoping section 200 and allows the scoping section 200 to move in relation to the body section 100. In an example, a pair of plates 220 securely attach to the respective outer side surfaces close to the front ends of the beams 208 and 210, and the roller 212 has an axis and is rotatably secured on the pair of plates 220. Each plate has a bore that receives an end of the axis of the roller 212. In another example, the scoping section 200 may have two separate rollers rotatably mounted under the front end of the respective beams 208 and 210. In another example that sliding arrangement is omitted, a second roller similar to the roller 212 may be rotatable mounted close to the rear end of the beams 208 and 210 or the bottom horizontal beam 214,and the second roller and the roller 212 collectively provide the mobile stability of the scoping section 200 and support the scoping section 200.

The bottom horizontal beam 214 is connected with two beams 208 and 210 close to their front ends, such as by connecting to two opposite inner sides of the two beams 208 and 210. In the example in FIGS. 1-5, the vertical beams 215 and 216 are securely connected to the top surface and close to the two ends of the bottom horizontal beam 214. In the example in FIGS. 6-9, the vertical beams 215 and 216 are securely connected to the top surfaces close to the front ends of the beams 210 and 208, respectively.

The top horizontal beam 224 is configured to be removably connected with the vertical beams 215 and 216. In the example of FIGS. 1-5, the top horizontal beam 224 is removably connected to two top surfaces of the vertical beams 215 and 216. In the example of FIGS. 1-5, two end portions of the top horizontal beam 224 are placed on respective top surfaces of the vertical beams 215 and 216. The plates 238*a* and 238*b* are secured to two respective end surfaces of the top horizontal beam 224. The plates 238*a* and 238*b* extend downwardly along outer surfaces of respective vertical beams 215 and 216. A bottom portion of each of plates 238*a* and 238*b* is secured on the respective vertical beams 215 and 216 by fastener, such as bolts and nuts. The top horizontal beam 224 may be removed from the vertical beams 215 and 216, for example for receiving a pipe on the retention member, by removing the fasteners.

In the embodiment illustrated in FIG. 1, a U-shaped carrier is secured close to the top end on the inner surface of each of the vertical beams 215 and 216, and extends upwardly along the inner surface, so that when the top horizontal beam 224 is placed on the support frame 201, the top horizontal beam 224 is received substantially within the two arms of the U-shaped carrier. The U-shaped carriers 280*a* and 280*b* provide additional support to the top horizontal beam 224, when a pipe is pulled out from or pushed into the RCD head.

In the embodiment of FIGS. 6-9, the top horizontal beam 224 is removably placed between the vertical beams 215 and 216, for example, between the inner surfaces and close to the top end of the vertical beams 215 and 216. A front plate 222 may be used to enhance the integrity of the support frame 201. The front plate 222 is placed in front of the top horizontal beam 224 and substantially against the front surface of the horizontal beam 224. The front plate 222 has two ends which cover at least a portion of the respective front surfaces of the vertical beams 215 and 216. The front plate 222 is secured on the vertical beams 215 and 216 by fastening two ends of the front plate 222 on the respective vertical beams 215 and 216. In an example, the front plate 222 is secured on the front surfaces of the vertical beams 215 and 216 by bolts and nuts. The vertical beams 215 and 216 may have a plurality pairs of threaded bores for receiving the threaded bolts at different positions. For example, each pair of threaded bores on vertical beams 215 and 216 has the same height from the bottom beam 214. As such, the height of the top horizontal beam 224 is adjustable. As well, the top horizontal beam 224 may be removed from the support frame 201, for example for receiving a pipe on the retention member, by removing the fasteners.

The retention member 203 may include a pair of jaws that engage a pipe for example by using a threaded drive mechanism. In the examples of FIGS. 1-9, the pair of jaws includes the top jaw 205 adjustably secured on the top horizontal beam 224, the bottom jaw 207 adjustably secured on the middle horizontal beam 228 in the example of FIGS. 1-5, or on the bottom horizontal beam 214 in the example of FIGS. 6-9.

The top jaw 205 has a press surface and the bottom jaw 207 has a support surface. The support surface of the bottom jaw 207 supports the pipe received on the bottom jaw 207. The press surface of the top jaw 205 presses and thus secures the pipe received on the support surface of the bottom jaw 207. In an example, as illustrated in FIGS. 1, 4, 5, 6 and 9, each of the press surface and the support surface are and substantially correspond with the arcuate contour of a pipe. The greater the press surface and the support surface area, the greater friction force between the pipe and the jaws.

In an example, the top jaw 205 is secured at the bottom end of the threaded rod 226 below the horizontal beam 224. The top horizontal beam 224 has a threaded through bore for receiving a threaded rod 226. The threaded rod 226 passes through the threaded bore of the top horizontal beam 224 with the top jaw 205 beneath the top horizontal beam 224. The top end of the threaded rod 226 may be rotated to adjust the height of the top jaw 205. By rotating the threaded rod 226, the height of the top jaw 205 may be adjusted to accommodate pipes with different sizes and to align a pipe with the front end bore of the RCD head.

The middle horizontal beam 228 in FIGS. 1-5 is securely connected to two opposite inner sides of the vertical beams 215 and 216, and is between the bottom horizontal beam 214 and the top horizontal beam 224. The middle horizontal beam 228 securely retains the bottom jaw 207. In an example, the middle horizontal beam 228 has a threaded through bore for receiving a threaded rod. In an example, the threaded rod passes through the threaded bore defined in the horizontal beam 228. The bottom jaw 207 is secured on the top end of the threaded rod and above the middle beam 228. In an example, the height of the bottom jaw is fixed. In another example, the height of the bottom jaw 207 is adjustable by rotating the threaded rod to align the pipe with the front end of the RCD head.

The middle horizontal beam 228 may be omitted. In the example of FIGS. 6-9, the bottom horizontal beam 214 securely retains the bottom jaw 207. In an example, the bottom horizontal beam 214 has a threaded through bore for receiving a threaded rod 230. In an example, the threaded rod 230 passes through the threaded bore defined in the bottom horizontal beam 214. The bottom jaw 207 is secured on the top end of the threaded rod 230 and above bottom horizontal beam 214. In an example, the position of the bottom jaw 207 is fixed. In another example, the height of the bottom jaw 207 is adjustable by rotating the threaded rod 230.

Figure 6:
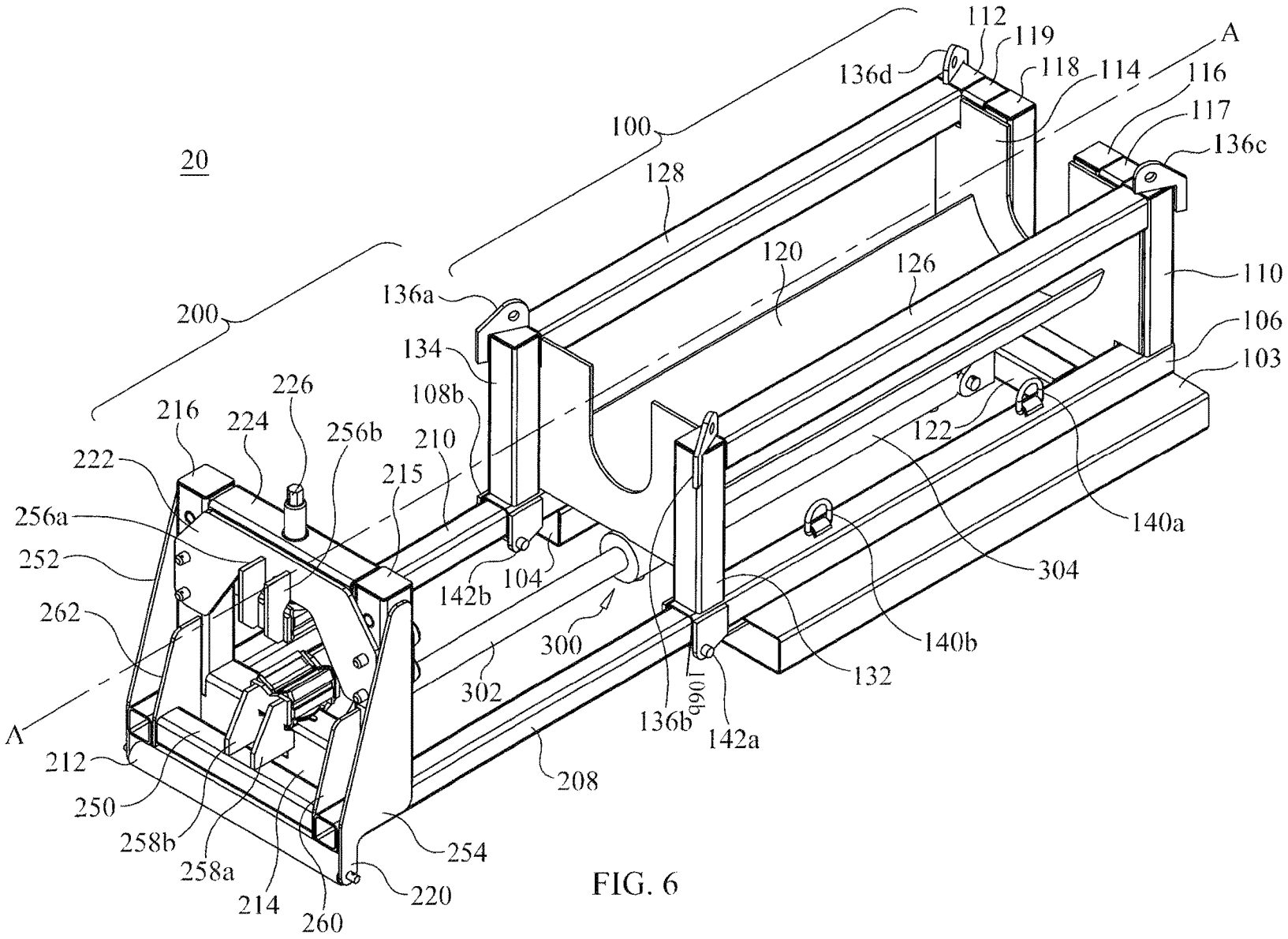
FIG. 6 is a front perspective view of an RCD head installer and remover, according to another embodiment.
Figure 7:
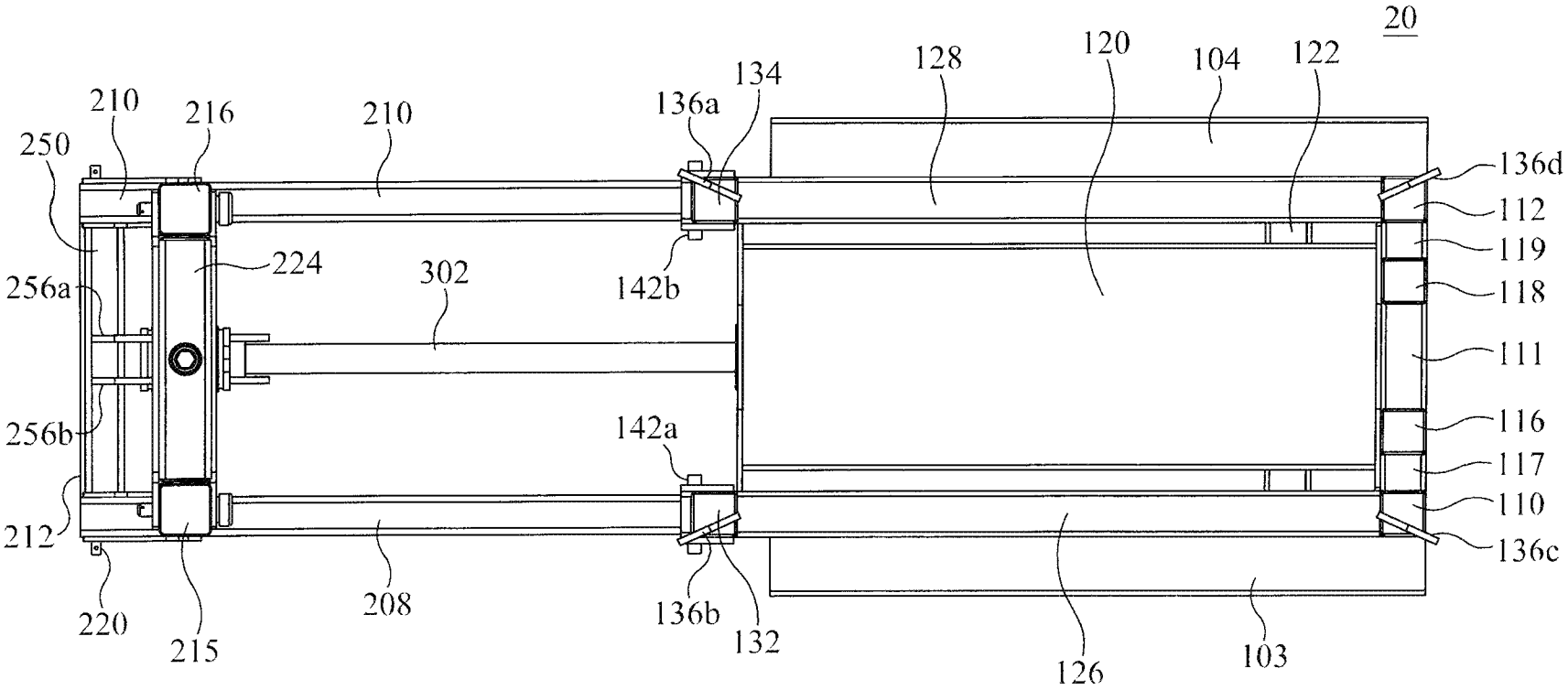
FIG. 7 is a top view of the RCD head installer and remover of FIG. 6.
Figure 8:
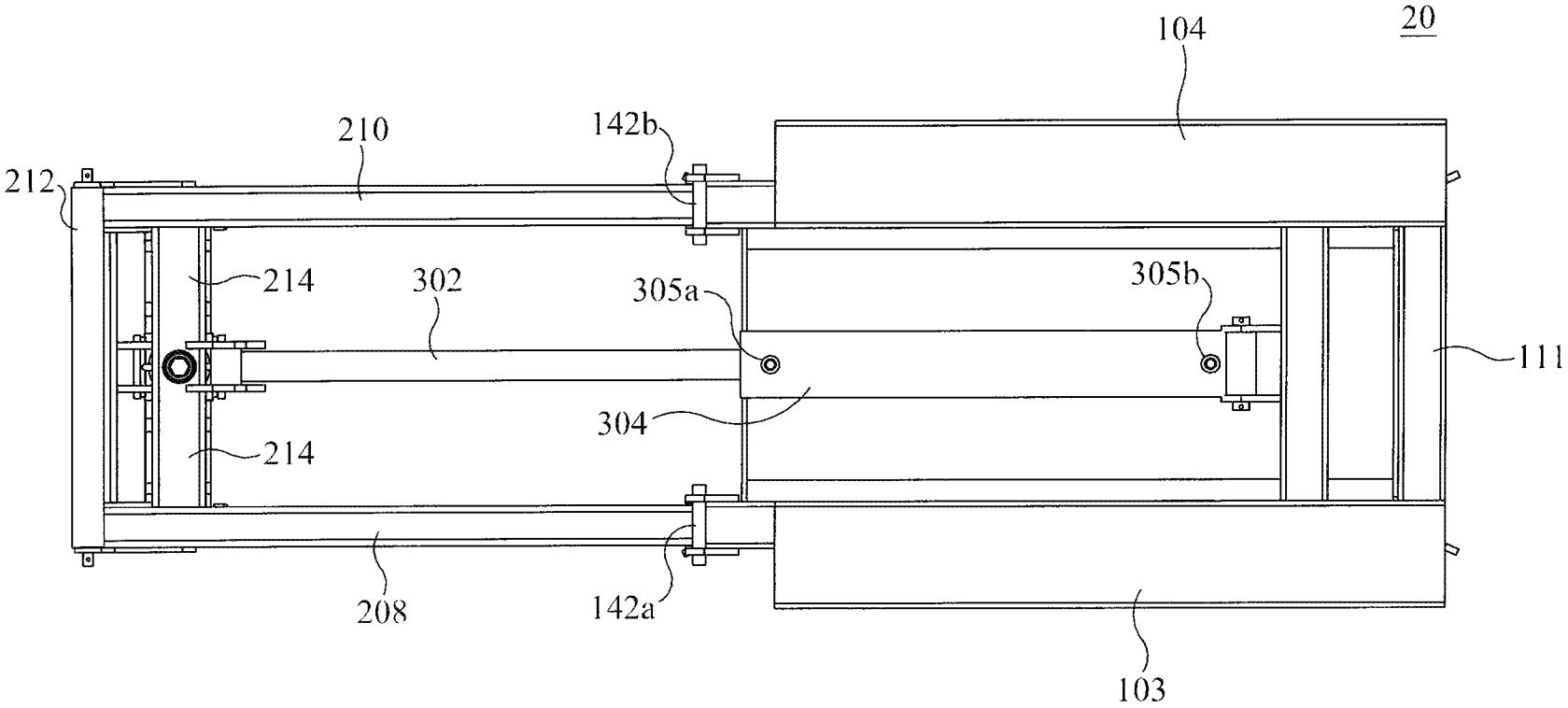
FIG. 8 is a bottom view of the RCD head installer and remover of FIG. 6.
Figure 9:
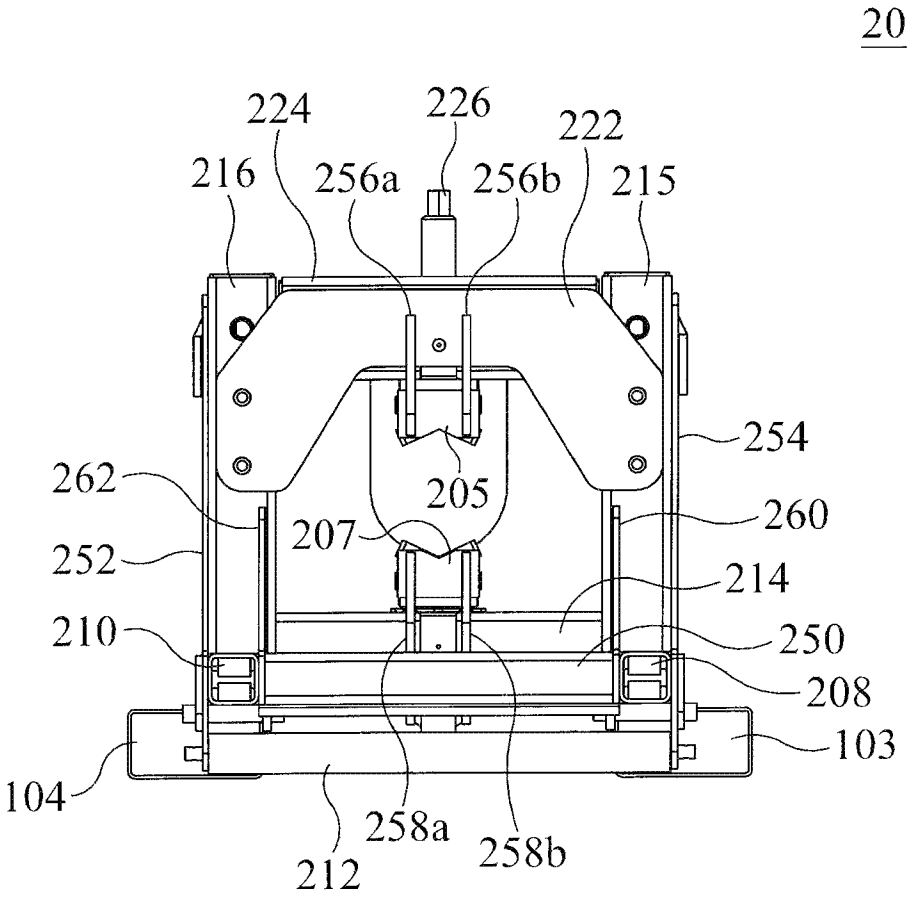
FIG. 9 is a front view of the RCD head installer and remover of FIG. 6.

In an example, the bottom and top jaws 205 and 207 have at least one retention plate mounted on the outer surfaces of the jaws 205 and 207. As illustrated in FIG. 6, the retention plates 256*a* and 256*b* on the top jaw 205 are secured on the outer surface of the top jaw 205 and extend upwardly along the beam 224 or the front plate 222. The retention plates 258*a* and 258*b* on the bottom jaw 207 is secured on the outer surface of the bottom jaw 205 and extend downwardly along the outer surface of the beam 214 or 228. When the jaws 205 and 207 retain the pipe, the retention plates on the top jaw 205 will be against the outer surface of the beam 224, and the retention plates on the bottom jaw 207 will be against the outer surface of the beam 228. As such, when a pipe is pushed into the RCD head, the retention plates will enhance the structure integrity of the bottom and top jaws 205 and 207.

The support frame 201 may include one or more structures for enhancing the integrity of the support frame 201. In an example, as illustrated in FIGS. 1-5, a triangular structure is used to reinforce the support frame 201. The triangular structure may include vertical beam 215, beam 217, and beam 218. One end of beam 218 is secured on the front surface of the horizontal beam 214 and extends longitudinally along the inner surface of beams 208 to the front end of beam 217. The beam 218 may also secure to the inner surface of the beam 234, for example by welding. The front end of the beam 218 may be aligned with the front end of the beam 234. One end of the beam 218 is connected with a top portion of the front surface of the beam 216, the other end of beam 218 is connected beam 218 on the top surface close to the front end of beam 218. In another example, the support frame 201 may include a second triangular structure substantially symmetric with the first triangular structure. For example, the second triangular structure may be formed in the same manner as the first triangular structure, and may include beam 215, beam 217 and a beam corresponding with 218.

As illustrated in the example of FIGS. 6-9, rather than use a triangular structure, at least one plate may securely attach to the support frame 201 to enhance the integrity of the support frame 201. The plate may have different shapes, such as a rectangular shape, a triangular shape, or a trapezoidal shape. In the example of FIGS. 6-9, a plate 252, which has substantially a triangular shape, securely attaches to the side surfaces of the beams 208 and the beam 216; a triangular plate 254 attaches to the side surfaces of the beam 210 and the beam 215. A trapezoidal plate 260 attaches to the inner side surface of beams 208 with an edge against the front side surface of vertical beam 215; and a trapezoidal plate 262 attaches to the inner side surface of beams 210 with an edge against the front side surface of vertical beam 216. The trapezoidal plates 260 and 262 may also securely attach to the front side surfaces of vertical beams 215 and 216.

The support frame 201 may include one or more beams to enhance the integrity of the support frame 201. As illustrated in FIG. 6, a front horizontal beam 250 may be securely place between the beams 208 and 210 and in front of the beam 214.

The support frame 201 securely retains an end of a pipe (not shown). The other end of the pipe may be placed on a pipe stand (not shown), such as a roller stand, for securing the other end of the pipe and for supporting the pipe. In an example, the pipe stand is movable along with the pipe when a force is applied to the scoping section 200. The pipe stand is adjustable, for example, from 12"-18", and is used to support the other end of the pipe. In some examples, the pipe stand is roller top stand for receiving a pipe to be removed or installed. The pipe stand may be close to the ground. The pipe stand allows the pipe to move along while the RCD head installer and remover 10 or 20 is in use and to maintain a level and easy moving path of the pipe without restriction. For example, when a pulling force is applied on the scoping section 200, such as on the support frame 201, the scoping section 200 and the pipe stand together carry a pipe and the pipe is horizontally moved away from the body section 100 which is substantially stationary due to the friction created between the frictional surface of the base 101 and the contacting surface. As such, the pipe is pulled off from the RCD head. Similarly, when a push force is applied on the scoping section 200, such as on the support frame 201, the scoping section 200 and the pipe stand carry a pipe and pipe moves horizontally towards the body section 100 which remains substantially stationary due to the friction. As such, the pipe is pushed into the RCD head. In another example, the pipe stand is not movable but the pipe is moveable on the surface of the pipe stand when a force is applied to the scoping section 200. For example, at least one roller may installed on the pipe stand to allow the pipe moveable.

The push and pull forces may be provided by an actuator 300. The actuator 300 may be, for example, a hydraulic actuator such as a hydraulic system, a pneumatic actuator, an electric actuator, or a mechanical actuator such as pulleys and chains.

A hydraulic system may be used to provide the push and pull forces. A hydraulic system includes a hydraulic ram and hydraulic control system. As illustrated in the example of FIGS. 1-9, a hydraulic ram includes a piston rod 302 and cylinder housing 304. The hydraulic ram, together with the hydraulic control system (not shown), provides the push force to the support frame 201 when the piston rod 302 moves into the cylinder housing 304, and the pull force to the support frame 201 when the piston rod 302 moves out from the cylinder housing 304. The piston rod 302 has a first end outside the cylinder housing 304 and a second end inside the cylinder housing 304. The first end of the piston rod 302 is connected with a clevis securely connected with the support frame 201, such as with the bottom horizontal beam 214. The cylinder housing 304 has a front end with a bore to receive the second end of the piston rod 302 and a rear end with pins and retainers to securely retain the cylinder housing 304 on the body portion 100. For example, the pin and retainer is connected with the middle portion of a horizontal beam 122 beneath the support base 120. The position of the horizontal beam 122 may be selected based on the length of the cylinder housing 304, for example, at a position where the front end of the cylinder housing 304 is substantially aligned with the edge of the front board 130. In another example, the cylinder housing 304 may also be secured on the support base 120, such as by welding at a portion of the cylinder housing 304 close to the first end.

The cylinder housing 304 may have a plurality of the ports, such as ports 305*a* and 305*b* (see FIG. 8), each for connecting with a hydraulic hose of a hydraulic control system (not shown). The hydraulic system controls the pressure of the hydraulic flow in the hoses. The hydraulic control system may run from a Power Tong truck that is used to transport the RCD head installer and remover 10 or 20 and pipes. By controlling the pressure of the hydraulic flow in different hoses, the hydraulic control system causes the piston rod 302 to move in or out from the hydraulic housing 304. When the hydraulic ram actuates the scoping section 200, scoping section 200 moves towards or away from the body section 100 as the piston rod 302 moves towards or away from the cylinder housing 304. The travel distance of the scoping section 200 with respect to the body section 100 corresponds to the amount of travel that the piston rod 201 moves in or out from the cylinder housing 304.

In an example, one stroke of the piston rod 302, i.e., the greatest amount of travel that the piston rod 302 can move out from the cylinder housing 304, is about 30".

Figure 10:
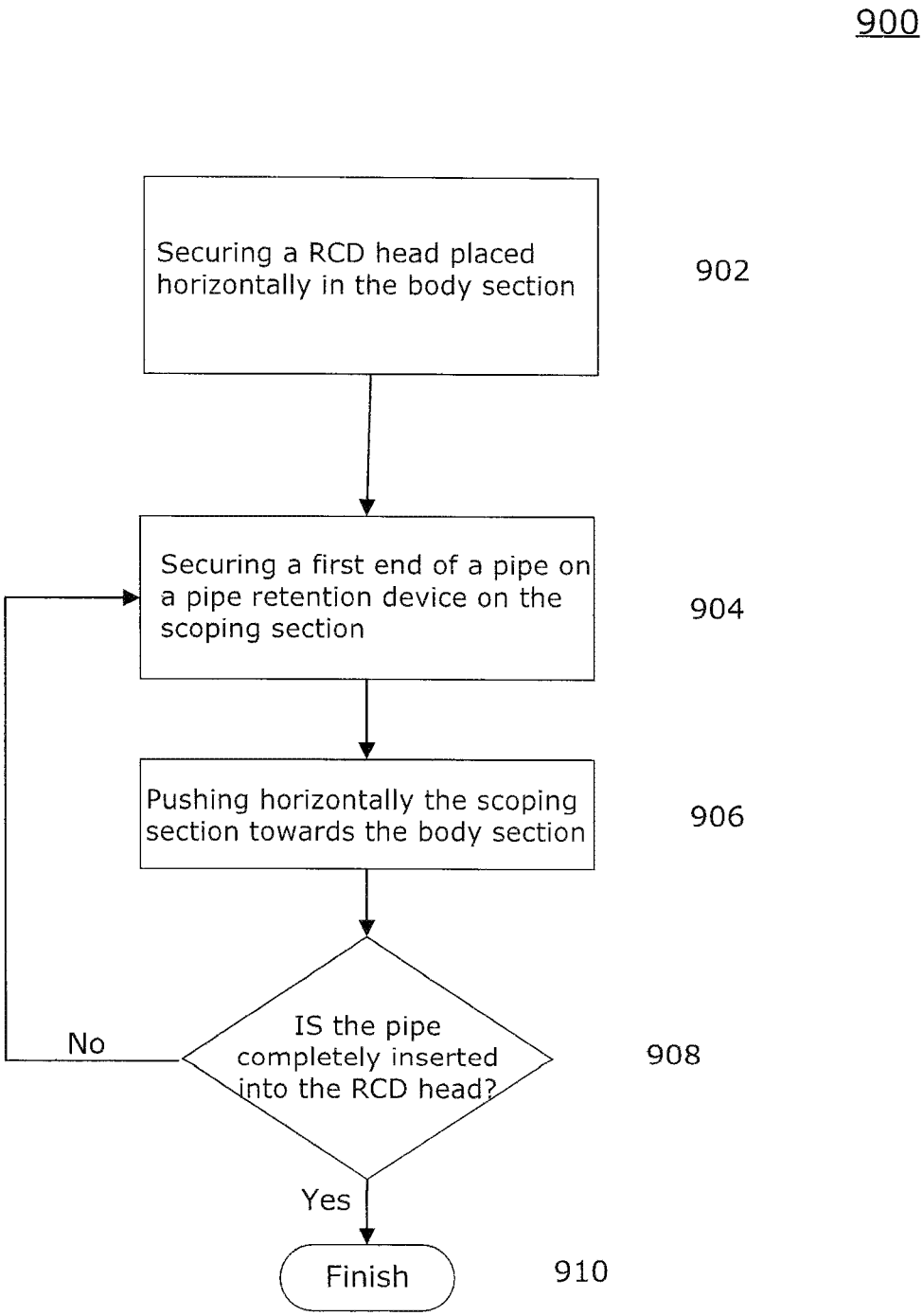
FIG. 10 is a flow chart showing an exemplary process of installing a pipe on an RCD head.

FIG. 10 is a flowchart showing exemplary steps of installing a pipe in a RCD head with a RCD head installer and remover 10 or 20. First, the work area where the RCD head installer and remover 10 or 20 is used to install a pipe in a RCD head is clear from irrelevant workers and equipment during the use of the RCD head installer and remover 10 or 20. The work area may be an empty level ground. The selected work area is sufficiently level to prevent binding when the pipe is moved in relation to the RCD head using the RCD head installer and remover 10 or 20. By installing the pipe on the RCD head with the RCD head installer and remover 10 or 20 off the rig floor, the work area may be selected as large as necessary. As such, the safety hazards to rig floor crew in the installation of the pipe on the RCD head on the rig floor will be reduced.

The RCD head installer and remover 10 or 20 and the pipe may be transported to the work area by a transport vehicle. The RCD head installer and remover 10 or 20 and the pipe then may be unsecured and removed from the transport vehicle at the work area. For example, lifting eyes may be connected with the lifting lugs 136*a*-136*d* of the RCD head installer and remover 10 or 20, and a sling may be used to lift the RCD head installer 10 or 20 from the transport vehicle to the work area. The pipe may also be slung from the transport vehicle to the work area. A tag line may be used to prevent the RCD head installer and remover 10 or 20 and the pipe from swinging during the lifting process.

In the example when the actuator 300 is a hydraulic system, hydraulic hoses, which are secure and free of leaks, are connected to the relevant ports on the cylinder housing 304 of a hydraulic ram. A hydraulic control system provides a flow control. In an example, a Power Tong trucks is used to provide the drive mechanism of the hydraulic control system.

At step 902, the RCD head is placed horizontally and secured on the body section 100. For example, the RCD head may be slung from a transport vehicle and horizontally placed on the support base 120 and between the top beams 126 and 128. The rear end of the horizontally placed RCD head is facing the front surface of the rear barrier 125. The front end of the RCD is facing the scoping section 200 for receiving a pipe. If the RCD head installer and remover 10 or 20 includes a front barrier 124, the front end of the RCD is facing the rear surface of the front barrier 124. Additionally and alternatively, the RCD head may be secured on the body section 100 with a strap, such as a 2" strap, and the D-ring welds 140.

The scoping section 200 is initially moved away from the body section 100. For example, by stroking the piston rod 302 out from the cylinder housing 304, the piston rod 302 drives the scoping section 200 away from the body section 100 with which cylinder housing 304 is securely connected. In an example, the piston rod 302 is completely stroked out from the cylinder housing 304, such as by 30".

At step 904, a first end of the pipe is secured on the retention member 203 of the scoping section 200. In the example that the retention member 203 is a pair of jaws 205 and 207, the top jaw 205 of the vise may be removed from the scoping section 200, for example by removing the top horizontal beam 224, to which the top jaw 205 is attached, from the support frame 201. A first end of the pipe is horizontally placed on the bottom jaw 207, for example by using a sling or a fork. The height of the secured first end of the pipe may be adjusted at an appropriate position for the pipe to be received by the bore of the RCD head, for example by adjusting the height of the bottom jaw 207 before the first end of the pipe is place on the bottom jaw 207. As well, the size of the jaws 205 and 207 may be replaced with appropriate sizes in order to securely retain the pipes of different sizes.

The second end of the pipe may be horizontally placed on a pipe stand, such as a roller stand. The top horizontal beam 224 along with top jaw 205 may then be installed on the support frame 201. The top jaw 205 and the bottom jaw 207 together secure the first end of the pipe horizontally placed on the support frame 201, for example by tightening the top jaw 205 on the pipe as tight as possible with a vise wrench. The secured first end of the pipe may be, for example, approximately 1" away from the RCD head bore. After the pipe is secured on the support frame 201 and on the roller stand, the RCD head installer and remover 10 or 20 and the roller stand are placed on a substantially flat surface, and the pipe is substantially horizontal placed on the scoping section 200 and roller stand. As such, the pipe will not bind when the scoping section 200 carrying the pipe moves in relation to the body section 100.

Before start pushing the first end of the pipe into the RCD head, the RCD head rubbers may be lubricated to help the pipe slide along the rubbers when the pipe is inserted into the RCD head. For example, the RCD head rubbers may be lubricated with lubricant such as casing compound, hydraulic oil, white lithium grease, or EP2 grease. The lubricant used may be oil based and not dry out the rubber.

At step 906, the actuator 300, such as a hydraulic ram, inserts the first end of the pipe into a front end bore of the RCD head by pushing the scoping section 200 with the first end of the pipe secured thereon toward the body section 100. In the example of FIGS. 1 and 6, as the piston rod 302 retracts into the cylinder housing 304 installed on the body section 100, the piston rod 302 pulls the scoping section 200 that carries the pipe, toward the body section 100 by pulling the bottom horizontal beam 214 of the support frame 201. The pipe is then pulled along with the scoping section 200 toward the front end bore of the RCD head secured on the body section 100. The first end of the pipe is gradually pushed into the bore of the RCD head via the RCD head rubbers, as the scoping section 200 keeps moving toward the body section 100. When inserting the pipe into the rubber of the RCD head, the hydraulic control system may gradually increase the pulling force of the piston rod 302 by controlling the hydraulic pressure until the pipe begins to move freely through the RCD head rubbers of the horizontally securely RCD Head.

During the process of applying a pulling force with a hydraulic ram, a consistent and controlled rate of hydraulic pressure is applied to the hydraulic ram until the hydraulic ram reaches the end of its stroke or until the pipe has completely inserted into the RCD head. The pipe is completely inserted into the RCD head when the first end of the pipe has been inserted into the RCD head for a predetermined length as required for use on the rig floor. For example, the installation is complete when approximately 1.5-2 meters of the pipe are visible through and on the other end of the RCD head. This gives enough allowable length from rig floor make-up.

At step 908, an operator of the RCD head installer and remover 10 or 20 closely monitors whether the pipe has been completely inserted into the RCD head. In the case of the hydraulic ram, a single stroke may be insufficient to completely insert the pipe into the RCD head. If the pipe has not completely inserted into the RCD head at the end of one stroke of the hydraulic ram, the operator releases any hydraulic pressure, releases the retention member 203 from the pipe such as by releasing the top and bottom jaws 205, 207 from the pipe, moves the scoping section 200 away from the body section 100, for example by stroking the piston rod 302 out from the cylinder housing 304 to its starting position, and repeats steps 904-908. This process is repeated until the pipe is completed inserted into the RCD head. The pipe installation process is completed at step 910 when the pipe is completely inserted into the RCD head. The RCD installed with the pipe may then be transported to a rig floor for use.

Figure 11:
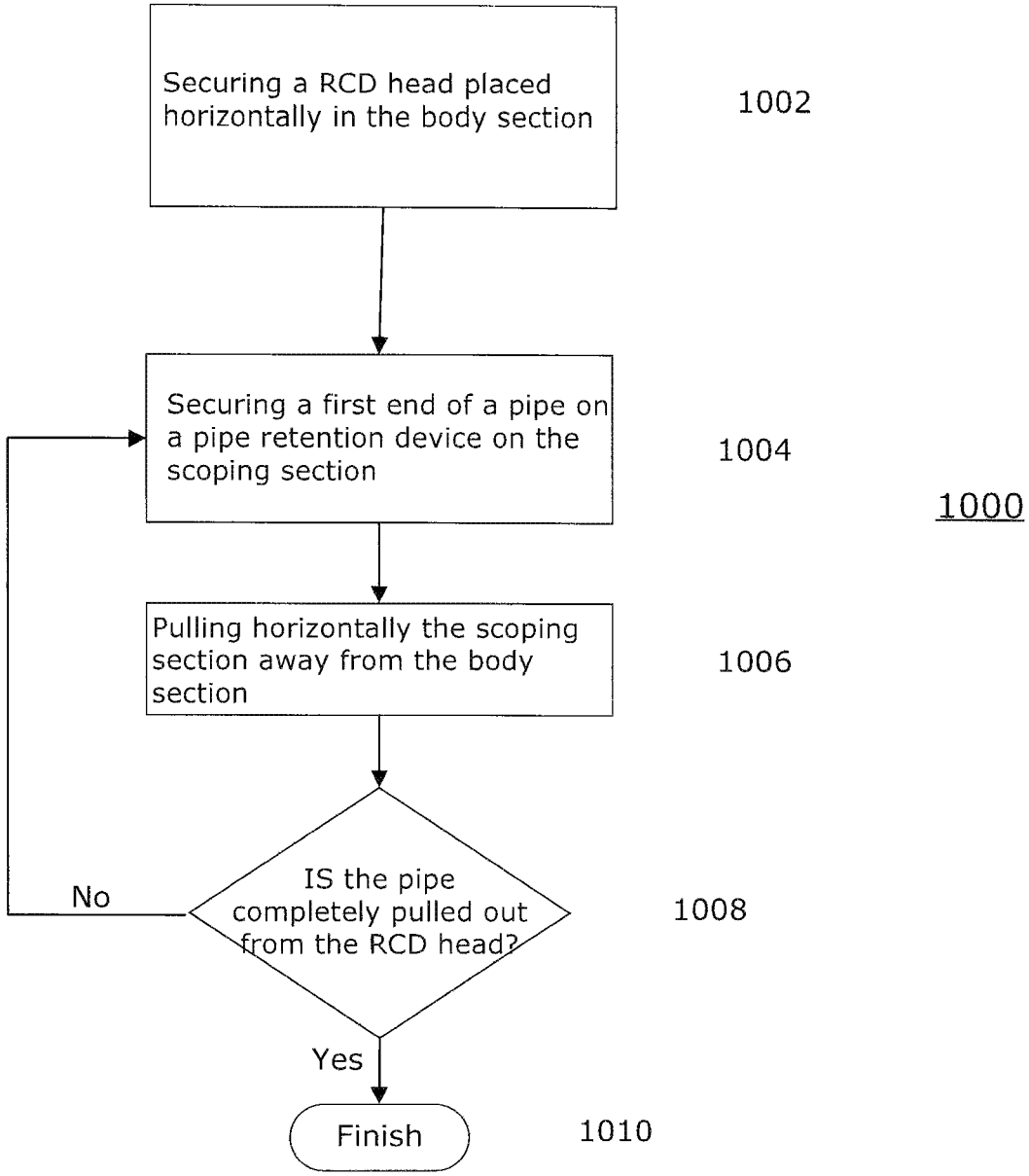
FIG. 11 is a flow chart showing an exemplary process of removing a pipe from an RCD head.

FIG. 11 is a flow chart showing exemplary steps for removing a pipe from a RCD head with the RCD head installer and remover 10 or 20. In similar manners described in the installation process, the RCD head installer and remover 10 or 20 may be removed from a transport vehicle to a work area.

Unlike the installation process, the scoping section 200 is initially moved close to the body section 100. For example, by stroking the piston rod 302 in the cylinder housing 304 in FIG. 1 or 6, the piston rod 302 drives the scoping section 200 close to the body section 100 with which cylinder housing 304 is securely connected. In an example, the piston rod 302 is completely stroked in the cylinder housing 304.

The RCD head and the pipe installed on the RCD head may be slung from a transport vehicle and simultaneously horizontally placed on body section 100 and scoping section 200, respectively. In the example that the retention member 203 is a pair of jaws 205 and 207, the top jaw 205 of the vise may be removed from the scoping section 200, for example by removing the top horizontal beam 224 with the top jaw 205 attached from the support frame 201. The pipe installed on the RCD head goes through the U-shaped carve-out of the front barrier, and the first end of the pipe is horizontally placed on bottom jaw 207, for example by using a sling or a fork, and the second end of the pipe is horizontally placed on a support stand, such as a roller stand.

At step 1002, the RCD head is placed horizontally and secured on the body section 100. For example, the RCD head may be placed horizontally on the support base 120 and between the top beams 126 and 128. The front end of the RCD head is facing the rear surface of the front barrier 124. If the body section 100 includes a rear barrier 125, the rear end of the horizontally placed RCD head is facing the front surface of the rear barrier 125. Additionally, and alternatively, the RCD head may be secured on the body section 100 with a strap, such as a 2" strap, and the D-ring welds 140.

At step 1004, a first end of the pipe is secured on the retention member 203 of the scoping section 200. The first end of the pipe is horizontally placed on the bottom jaw 207. The top horizontal beam 224 along with top jaw 205 may then be installed on the support frame 201. The top jaw 205 and the bottom jaw 207 together secure the first end of the pipe horizontally placed on the support frame 201, for example by tightening the top jaw 205 on the pipe as tight as possible with a vise wrench. The height and the size of the jaws 205 and 207 are adjustable to securely retain the first end of the pipe as described above. After the pipe is secured on the support frame 201 and on the roller stand, the RCD head installer and remover 10 or 20 and the roller stand are on a substantially even surface, and the pipe is substantially horizontal placed on the scoping section 200 and roller stand. As such, the pipe will not bind when the scoping section 200 carrying the pipe moves in relation to the body section 100.

At step 1006, the actuator 300, such as a hydraulic ram, removes the first end of the pipe out from a front end bore of the RCD head by horizontally pulling the scoping section 200 with the first end of the pipe secured thereon away from the body section 100. In the example of FIGS. 1 and 6, as the piston rod 302 securely connected with the scoping section 200 extends from the cylinder housing 304 installed on the body section 100, the piston rod 302 pushes the scoping section 200 carrying the pipe away from the body section 100 by pushing the bottom horizontal beam 214 of the support frame 201. During this process, the body section 100 is substantially stationary in relation to the scoping section 200. The first end of the pipe is gradually pulled out from the bore of the RCD head via the RCD head rubbers, as the scoping section 200 moves toward the body section 100. When pulling the pipe out from the RCD head, the hydraulic control system may gradually increase the pushing force of the piston rod 302 by controlling the hydraulic pressure until the pipe begins to move freely through the horizontally securely RCD Head.

During the process of applying a pushing force with a hydraulic ram, a consistent and controlled rate of hydraulic pressure is applied to the hydraulic ram until the hydraulic ram reaches the end of its stroke or until the pipe has completely pulled out or detached from the RCD head.

At step 1008, an operator of the RCD head installer and remover 10 or 20 closely monitors whether the pipe has been completely pulled out from the RCD head. In the case of the hydraulic ram, a single stroke may be insufficient to completely pull the pipe out from the RCD head. If the pipe has not completely pulled out from the RCD head at the end of one stroke of the hydraulic ram, the operator releases any hydraulic pressure, releases the retention member 203 from the pipe such as by releasing the top and bottom jaws 205, 207 from the pipe so that the scoping section 200 along the with the retention member 203 can freely move toward the body section, moves the scoping section 200 towards the body section 100, for example by partially or completely retracting the piston rod 302 into the cylinder housing 304, and repeats steps 1004-1008. This process is repeated until the pipe is completed pulled out from the RCD head. The pipe removal process is completed at step 1010 when the pipe is completely pulled out from the RCD head. During the removal process, due to the tool joint—the enlarged and threaded ends of joints of the pipe, the torque will increase near the end, and this may cause slipping.

By installing the pipe onto the RCD head horizontally with the RCD head installer and/or removing the pipe from the RCD head horizontally with the RCD remover at a work area, neither the pipe nor the RCD head needs to be lifted up vertically to mount pipe on the RCD head or to remove the pipe from the RCD head, and the installation and removal process can be completed only by one operator in a controllable manner. As such, with the RCD head installer and remover 10 or 20, work place safety has been improved by installing the pipe onto the RCD head horizontally and/or by removing the pipe from the RCD head horizontally. As well, as pipe is installed on the RCD head or removed form the RCD head offline at the work area, no rig time is needed in the installation and removal processes, and thus rig time is saved. With multiple stoke hydraulic ram, the RCD head installer and remover 10 or 20 has a compact size and may be fit in and transported with a pick-up truck.

After the pipe is installed on the RCD head or removed from the RCD head, the top beam 224 and the top jaw 205 may be uninstalled from the vise, and the piston rod 302 may be completely retract back to the cylinder housing 304 for transportation. The hydraulic ram may be disengaged with the hydraulic control system and the hoses may be removed. Using the lifting eyes and a sling, the RCD head installer and remover 10 or 20, the RCD head with pipe installed, or the RCD head without the pipe and the pipe may be lifted and secured on the transport vehicle for transporting to the rig floor for use.

Certain adaptations and modifications of the described embodiments can be made. Therefore, the above discussed embodiments are considered to be illustrative and not restrictive.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention in its broader aspects, and, therefore, the aim in the appended claims is to cover all such changes and modifications as fall within the true spirit and scope of the present disclosure.

What is claimed is:

1. A device for installing a pipe to a rotating control device (RCD) head or for removing the pipe from the RCD head, comprising:

a body section for receiving and securing a RCD head placed thereon; and a scoping section configured to secure a first end of the pipe, and to horizontally push the first end of the pipe into a bore of the RCD head or to horizontally pull the first end of the pipe out from bore of the RCD head, wherein the body section is configured to be substantially stationary when the scoping section pushes the first end of the pipe into the bore of the RCD head, or when the scoping section pulls the first end of the pipe out from the bore of the RCD head.

2. The device of claim 1, wherein the body section comprises a base and a main frame securely attached on the base, wherein the base is configured for generating a friction force with a ground surface, and where the main frame is configured to receive and securely retain the RCD head.

3. The device of claim 2, wherein the main frame includes a horizontal support base for horizontally receiving the RCD head.

4. The device of claim 3, wherein the horizontal support base has a surface that substantially corresponds to a partial contour of the RCD head.

5. The device of claim 2, wherein the main frame includes a rear barrier for preventing a rear end of the RCD head from moving away from the scoping section when the scoping section pushes a pipe into the RCD head.

6. The device of claim 2, wherein the main frame includes a front barrier for preventing a front end of the RCD head from moving toward the scoping section when the scoping section pulls the pipe connected with the RCD head out from the RCD head.

7. The device of claim 6, wherein the front barrier includes a front board having an opening for allowing the pipe to go through the front barrier.

8. The device of claim 2, wherein the main frame includes two substantially parallel hollow bottom beams for receiving two respective core beams of the scoping sections.

9. The device of claim 8, wherein the two substantially parallel hollow bottom beams are inverted channels.

10. The device of claim 9, wherein each of the two substantially parallel hollow bottom beams includes least one roller for facilitating reception of the respective core beam of the scoping section.

11. The device of claim 2, wherein the main frame includes a plurality of lifting lugs for lifting the device.

12. The device of claim 2, wherein the main frame includes two top beams for preventing left or right side movement of the RCD head.

13. The device of claim 1, wherein the body section includes a plurality of D-ring tie downs.

14. The device of claim 1, wherein the scoping section includes a retention member for securely retaining the first end of the pipe, and a support frame for securely retaining the retention member, wherein the support frame is configured to be moveable in relation to the body section.

15. The device of claim 14, wherein the retention member is a pair of adjustable top and bottom jaws.

16. The device of claim 15, wherein the support frame includes a removable first horizontal beam for securing the top jaw, and a second horizontal beam for securing the bottom jaw.

17. The device of claim 16, wherein heights of the top jaw and the bottom jaw are separately adjustable.

18. The device of claim 15, wherein the top jaw has a press surface and the bottom jaw has a support surface for supporting the pipe received on the bottom jaw.

19. The device of claim 14, wherein the support frame includes two parallel longitudinal beams for sliding into two respective hollow bottom beams of the body section.

20. The device of claim 19, wherein the scoping section includes at least a roller at front ends of the two parallel longitudinal beams for the scoping section to move in relation to the body section.

21. The device of claim 1, further comprising a movable pipe stand for securing a second end of the pipe, wherein the pipe stand is movable along with the pipe when a force is applied to the scoping section.

22. The device of claim 1, further comprising an actuator for driving the scoping section.

23. The device of claim 1, wherein the actuator is a hydraulic actuator comprising a hydraulic ram and a hydraulic control system for controlling the hydraulic ram.

24. The device of claim 23, wherein the hydraulic ram includes a piston rod with one end secured on the scoping section and a cylinder housing with one end secured on the body section.

25. A method of installing a pipe into a RCD head, comprising:

securing a RCD head placed in a body section of a RCD head installer;

securing a first end of a pipe on a pipe retention member on a scoping section of the RCD head installer; and inserting the first end of the pipe into a front end bore of the RCD head by horizontally pushing the scoping section towards the body section.

26. A method of removing a pipe out from a RCD head, comprising:

securing a RCD head placed in a body section of an RCD head installer;

securing a first end of a pipe on a pipe retention member on a scoping section; and removing the first end of the pipe out from a front end bore of the RCD head by horizontally pulling the scoping section away from the body section.

* * * * *